United States Patent [19]

Outlaw

[11] 4,275,468

[45] Jun. 30, 1981

[54] WINTER JERSEY WITH HAND WARMER

[76] Inventor: Homer G. Outlaw, 855 N. Carrollton, Apt. 8, Baton Rouge, La. 70806

[21] Appl. No.: 38,727

[22] Filed: May 14, 1979

[51] Int. Cl.[3] ..... A41D 10/00; A41D 27/20

[52] U.S. Cl. ..... 2/115; 2/247

[58] Field of Search ..... 2/115, 108, 93, 125, 2/90, 247, 16, 69.5, 269

[56] References Cited

U.S. PATENT DOCUMENTS

| | | | |
|---|---|---|---|
| 1,444,750 | 2/1923 | Moore | 2/94 |
| 2,324,154 | 7/1943 | Haney | 2/94 |
| 2,613,360 | 10/1952 | Friedland et al. | 2/90 |
| 3,217,335 | 11/1965 | Bell | 2/247 |
| 3,378,852 | 4/1968 | Harter | 2/90 |

*Primary Examiner*—Doris L. Troutman

*Attorney, Agent, or Firm*—Staas and Halsey

[57] ABSTRACT

A cold weather jersey to be worn by participants in activities requiring the use of ungloved hands includes an upper body encasing portion made of warm material and suitable for wearing by a person while taking part in outside activities having attached thereto armlength sleeves for encasing the arms of a wearer, pocket structure being provided near the armpit area of the jersey either on the inside of the sleeves themselves or opposite thereto on the body portion of the jersey. The pockets may be fastened along three edges to provide a single opening thereto, or may be attached along the upper and lower parallel edges only so as to provide opening from the both the front and back of the jersey. This also permits the jersey to be made in a symmetrical manner and permits same to be quickly donned without regard to front or back. The pockets may be attached by sewing in the case of knitted, woven, and like material, or attached by heat sealing in the case of plastic material, or material including plastic.

10 Claims, 7 Drawing Figures

WINTER JERSEY WITH HAND WARMER

BACKGROUND OF THE INVENTION

1. Field of the Invention

This invention relates to jerseys or sweaters for use by sportsmen, hunters, and similar outdoor people who of necessity must have their hands unencumbered by gloves or the like.

2. Description of the Prior Art

A common problem with known type winter garments of the sweater type is that they protect the upper body or torso of the wearer and the arms thereof, but normally the hands of the wearer are exposed to the elements. Normally, a person wearing such a sweater can wear gloves and thus protect the hands. However, in many types of sports such as football, and other outdoor activities such as hunting, it is a necessary requirement that the wearer's hand or hands be unencumbered for participation in the activity. That is, in football, the players handling the ball must be able to maintain a good grip theron, and obviously cannot wear gloves or other hand protective devices. However, if the player's hands are exposed for an extended period of time to the elements, it can seriously affect the playing quality of the person. Therefore, a garment with structure provided therewith for allowing intermittent warming of a player's hands is very desirable.

Another problem with known type winter garments that do provide some way for warming ones hands, is that the structure is not arranged so as to maximize the use of body heat, and/or the structure is positioned in a place which can be subject to destruction, again for example in football, an outside pocket could be easily torn off during play.

Existing prior patents which may be pertinent to this invention are as follows:

| INVENTOR | U.S. PAT. NO. | DATE GRANTED |
|---|---|---|
| Steinhauser | 95,615 | October 5, 1869 |
| West | 2,134,425 | January 25, 1938 |
| Jay | 2,153,838 | April 11, 1939 |
| Jones | 4,006,495 | February 8, 1977 |

None of these prior art patents offer the new and novel features of subject invention.

SUMMARY OF THE INVENTION

An object of the present invention is to provide a winter jersey with hand warmer structure which permits a wearer thereof to easily and quickly, as well as intermittently, warm his or her hands whenever desired.

Another object of this invention is to provide a garment which may be worn during the colder months of the year and permit the user to readily warm the hands without the use of encumbering devices such as gloves and the like.

A further object is to provide a sweater type garment having sleeves extending to the wrist and provided with pockets located in the armpit area between the sleeves and the upper part of the garment. The pockets may be either sewn or attached by other means such as heat sealing to either the inner side of the upper sleeve, or the outer side of the garment per se opposite to the inner sleeve near the armpit area.

One of the important advantages of the winter garment of this invention is in the fact that the hand warming pockets attached to the jersey or sweater device is protected from being caught by external objects, or persons, and torn off or otherwise damaged. Likewise, the positioning of the pockets permit the maximum utilization of body heat. It is well known that one's armpits have substantial warmth associated therewith. Thus, the garment of this invention utilizes this to the maximum amount possible.

Another important feature of the jersey of this invention is that the hand warming pockets may be located either on the inside armpit area of the sleeves, or opposite to this position, on the jersey body itself. In either position, the pocket structure is protected from damage, as well as providing maximum use of armpit heat.

Another feature is that the pockets may be sewn to the jersey body or sleeve along either two parallel sides, or around three sides by conventional sewing techniques, or in case the garment is made of the newer type fabrics, and/or plastic type material, the pockets may be attached by heat sealing or the like. This provides an inexpensive and easily manufactured product which can be distributed and sold at very low cost. Thus, substantially broadening the overall utility and availability to the consumer of the item.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
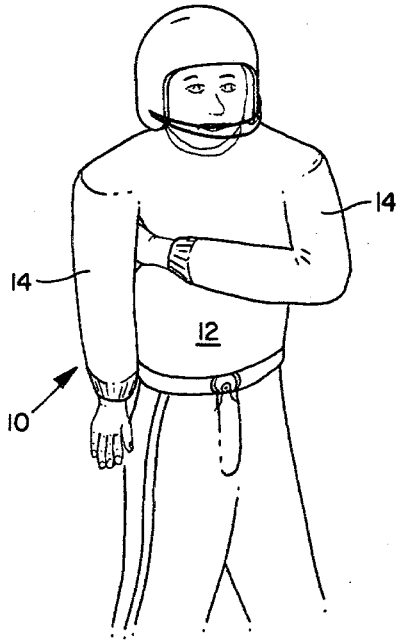
FIG. 1 is a perspective view of the winter jersey of this invention as in use.

Referring to FIG. 1 of the drawings, reference numeral 10 indicates in general the winter jersey of this invention as being worn by a football player.

Figure 2:
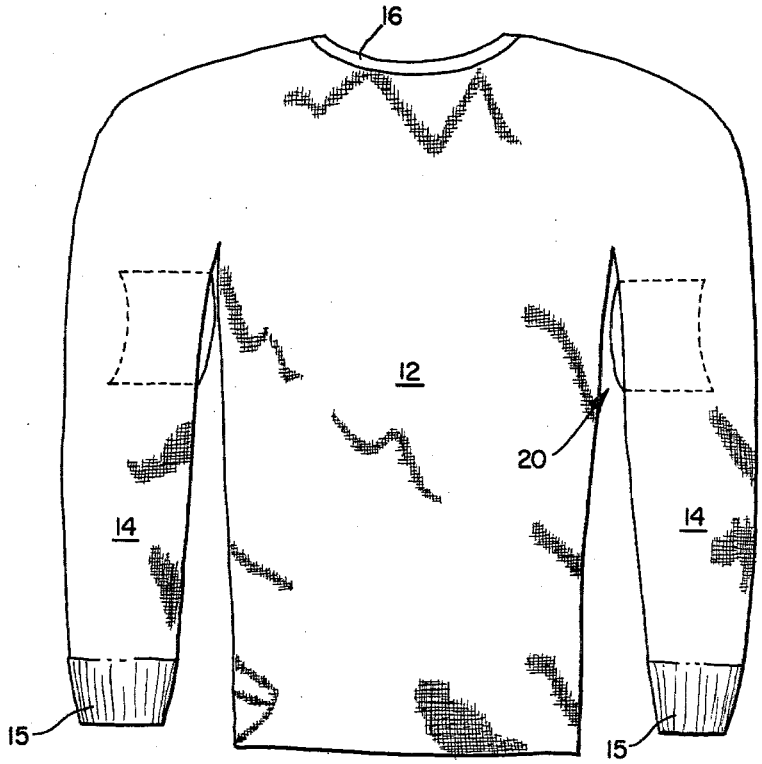
FIG. 2 is a front elevational view of the jersey per se.
Figure 3:
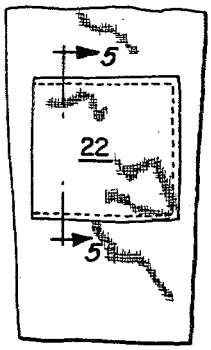
FIG. 3 is a fragmentary portion in elevation of the inner sleeve near the armpit area of the jersey.

FIG. 2 shows the jersey per se with the upper body covering portion 12, sleeves 14 attached thereto, with expansion cuffs 15, and a neck opening 16. The hand warming pocket is indicated generally by reference numeral 20. As shown in FIG. 2, each of the hand warming pockets is provided on the inner side portion of sleeve 14 near the armpit area of the jersey. The opening of each pocket 20 is toward the front of the jersey with the other three edges of the pocket portion 22 being attached to the sleeve. (See FIG. 3).

Figure 4:
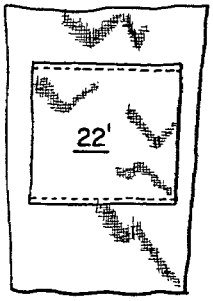
FIG. 4 is a view, partly in cross-section, taken generally along lines 4–4 of FIG. 3.

An alternate embodiment, FIG. 4, shows the pocket structure 22' being attached along just the upper and lower parallel edges of the pocket, leaving an opening both at front and the rear thereof. This embodiment is useful when the jersey is designed symmetrically so that it can be put on by a user without regard to which is the front and which is the back side. For use, such as by firemen, policemen, or other emergency type personnel where speed of putting on becomes important, such a non-front and back orientated sweater can offer numerous advantages. In this embodiment, obviously regardless of which way the sweater is put on, a person can put their hands into the hand protective and warming pocket structure.

Figure 5:
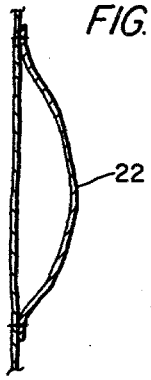
FIG. 5 is an alternate embodiment taken generally as the view of FIG. 4.

FIG. 5 shows attachment of the pocket structure 22 or 22' by means of sewing threads along the edges which are attached to the sleeve. Such sewing type attachment is one which can be readily performed by the ordinary housewife, as well as on production lines in a factory.

Figure 6:
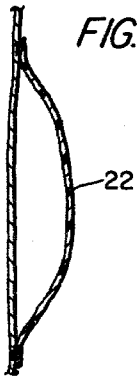
FIG. 6 is another alternate embodiment in front elevation showing the pocket structure on the body of the jersey.

FIG. 6 shows a modified attachment wherein some of the newer fabric materials, and/or plastic or plastic impregnated materials are used. For such type materials, the pocket may be attached along the appropriate edges by means of heat sealing of the plastic together. This embodiment offers the advantages of attractiveness and yet is suitable for mass production assembly. Jackets or sweaters made of plastic or plastic-like material can, by using a heat sealing method of pocket attachment, be made extremely fast and at relatively low-cost.

Figure 7:
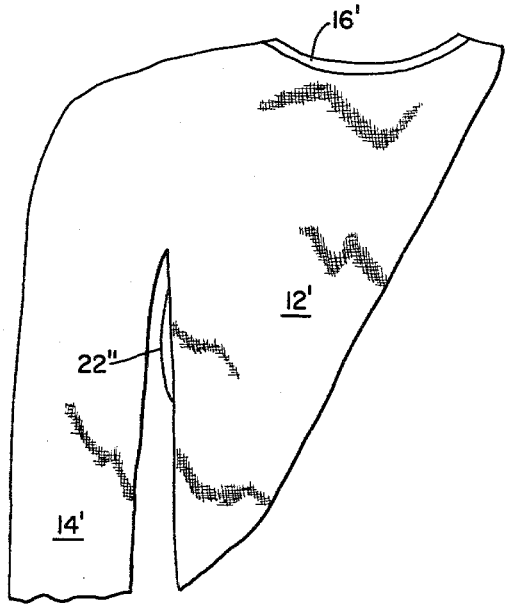
FIG. 7 is a further embodiment.

FIG. 7 shows another embodiment of the invention wherein the pocket structure 22' is applied on the upper part of the jersey near the armpit area of the sleeve connection, but opposite to the inner sleeve portion where the pockets were attached in the first embodiment. Again, this position utilizes the maximum warmth and heat of the armpit area of a wearer, while also offering protection against damage to the pocket. Such damage can occur in active sports such as football unless the pockets are placed in a place which is relatively protected by the body and arms of the wearer. Again, in the embodiment of FIG. 7, the pocket may be attached along all three edges similar to that shown in FIG. 3 for the first embodiment, or along only two of the parallel edges, upper and lower, as in the embodiment of FIG. 4. Similarly, the attachments may be either by thread for cloth or woven material as shown in FIG. 5, or by heat sealing for material containing plastic, as shown in FIG. 6.

The material used for the jersey or sweater of this invention should be relatively warm, while plastic may be used as already indicated, wool, one of the warmest materials, also may be used. Nylon and other such type materials also may be used. The jersey also may be hand knitted, woven, or produced by machine as per conventional sweater making.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A cold weather jersey to be worn by participants in activities requiring the use of ungloved hands comprising:

an upper body encasing portion made of warm material and suitable for wearing by a human while taking part in such activities;

said body encasing portion being provided with sleeve portions attached thereto for encasing the arms of a wearer; and means associated with the armpit area of the jersey for providing warmth and protection for the hands whenever desired by the wearer, wherein said means includes a pocket portion attached to at least one of the sleeves near the inner armpit portion thereof.

2. A cold weather jersey as in claim 1, wherein said pocket portion is fastened along at least two edges thereof thus providing at least one opening for insertion of a hand of a wearer.

3. The cold weather jersey as in claim 1, wherein the pocket is fastened along three edges thereof with the fourth edge being unfastened to provide only one opening for insertion of a hand of a wearer thereof.

4. A cold weather jersey as in claim 2, wherein the jersey is made of woven material and said pocket is fastened by sewing threads.

5. A cold weather jersey as in claim 2, wherein the jersey is made of material containing plastic, and said pocket is fastened thereto by heat sealing of the edges of the pocket to the jersey.

6. A cold weather jersey to be worn by participants in activities requiring the use of ungloved hands comprising:

an upper body encasing portion made of warm material and suitable for wearing by a human while taking part in such activities;

said body encasing portion being provided with sleeve portions attached thereto for encasing the arms of a wearer; and means associated with the armpit area of the jersey for providing warmth and protection for the hands whenever desired by the wearer, wherein said means includes a pocket portion attached to the body encasing portion directly opposite the inside sleeve portion under the armpit area.

7. A cold weather jersey as in claim 6, wherein said pocket portion is fastened along at least two edges thereof thus providing at least one opening for insertion of a hand of a wearer.

8. A cold weather jersey as in claim 6, wherein the pocket is fastened along three edges thereof with the fourth edge being unfastened to provide only one opening for insertion of a hand of a wearer thereof.

9. A cold weather jersey as in claim 8, wherein the jersey is made of woven material said pocket is fastened by sewing threads.

10. A cold weather jersey to be worn by participants in activities requiring the use of ungloved hands comprising:

an upper body encasing portion made of warm material and suitable for wearing by a human while taking part in such activities;

said body encasing portion being provided with sleeve portions attached thereto for encasing the arms of a wearer; and means associated with the armpit area of the jersey for providing warmth and protection for the hands whenever desired by the wearer, said means including a pocket portion attached to the body encasing portion directly opposite the inside sleeve portion under the armpit area, said pocket portion being fastened along at least two edges thereof thus providing at least one opening for insertion of a hand of a wearer, and the jersey is made of material containing plastic, and said pocket is fastened thereto by heat sealing of the edges of the pocket to the jersey.

* * * * *